US007464475B2

(12) United States Patent
Tsao

(10) Patent No.: US 7,464,475 B2
(45) Date of Patent: Dec. 16, 2008

(54) CONCEALED SPOON IN MILK POWDER CONTAINER

(76) Inventor: Charng-Shing Tsao, No. 99-6, Hsin Pei St., Hsin Ying city, Tainan Hsien (TW)

( * ) Notice: Subject to any disclaimer, the term of this patent is extended or adjusted under 35 U.S.C. 154(b) by 328 days.

(21) Appl. No.: 11/270,487

(22) Filed: Nov. 10, 2005

(65) Prior Publication Data

US 2007/0102061 A1 May 10, 2007

(51) Int. Cl.
*A47J 43/28* (2006.01)
*A47G 21/14* (2006.01)
*B65D 25/00* (2006.01)

(52) U.S. Cl. ..... 30/327; 215/391; 220/735; 248/37.6; 248/213.2; 248/229.16; 248/316.7

(58) Field of Classification Search ..... 30/298.4, 30/327; 220/735; 248/37.6, 213.2, 229.16, 248/316.7; 215/391
See application file for complete search history.

(56) References Cited

U.S. PATENT DOCUMENTS 784,830 A * 3/1905 Beistle ..... 30/327
1,768,771 A * 7/1930 La Tourrette ..... 141/380
2,597,275 A * 5/1952 Ahlstrand ..... 248/37.6
3,226,825 A * 1/1966 Molinaro ..... 30/327
4,095,716 A * 6/1978 Meany ..... 215/391
5,087,014 A * 2/1992 Desjardin ..... 248/692
5,105,963 A * 4/1992 Scott ..... 220/735
5,706,974 A * 1/1998 Murdick et al. ..... 220/735
5,823,483 A * 10/1998 Gaskill ..... 248/37.6
D440,116 S * 4/2001 Levie ..... D7/401.2
6,419,194 B1 * 7/2002 LoSacco et al. ..... 248/113
2006/0053638 A1 * 3/2006 Sumner-Trivisani et al. ..... 30/298.4

* cited by examiner

*Primary Examiner*—Hwei-Siu C Payer
(74) *Attorney, Agent, or Firm*—Leong C. Lei

(57) ABSTRACT

A concealed spoon in milk powder container is disclosed. The concealed spoon comprising a spoon seat and a measuring spoon, characterized in that the lateral side of the spoon seat has a clipping plate having an arch-shaped interior slot and an opening slot within the clipping plate, which are used to secure the spoon seat at the internal wall of the milk powder container proximity to the protruded circular lid of the container and the measuring spoon is held within the spoon seat, or the lateral side of the measuring spoon is a handle having an end section provided with an internal slot and an open slot which are used to directly secure the measuring spoon to the protruded circular lid proximity to the top section of the internal wall of the milk powder container.

1 Claim, 8 Drawing Sheets

CONCEALED SPOON IN MILK POWDER CONTAINER

BACKGROUND OF THE INVENTION (a) Technical Field of the Invention

The present invention relates to a concealed spoon, and in particular, to a concealed spoon mounted within a milk powder container.

(b) Description of the Prior Art

Taiwanese patent publication number 181478 entitled "spoon structure of a Medicine Container" discloses a container lid and a container body. The internal wall of the medicine container has a recess allowing a spoon to be inserted into the recess. The shortcoming of this structure is that if the end of the spoon handle is not fully inserted into the recess and an opening on the recess for the finger to be inserted in, it is not convenience to retrieve the spoon. If the end of the spoon is protruded above the recess, the lid will not cover the opening on the container body, and the contents within the container will leak.

Taiwanese patent publication number 405574 entitled "Container With a Spoon" discloses a container body and a spoon body. The container body is provided with a slot seat to hold the spoon. The drawback of the structure is that most of the time the spoon within the slot seat is exposed to external environment and the spoon may be contaminated.

Taiwanese patent publication number 335808 entitled "Lid containing a spoon" discloses a milk powder container lid having protruded blocks at the rear surface of the lid, and the blocks can hold the spoon at the edge. The drawback of this structure is that the spoon will touch the milk powder within the milk powder container.

In view of the above drawbacks, it is an object of the present invention to provide a concealed spoon in milk powder container which mitigates the shortcomings of the conventional lid or milk powder container including a concealed spoon.

SUMMARY OF THE INVENTION

The primary purpose of the present invention is to provide a concealed spoon in a milk powder container comprising a spoon seat and a measuring spoon, characterized in that the lateral side of the spoon seat has a clipping plate having an arch-shaped interior slot and an opening slot within the clipping plate, which are used to secure the spoon seat at the internal wall of the milk powder container proximity to the protruded circular lid of the container and the measuring spoon is held within the spoon seat, or the lateral side of the measuring spoon is a handle having an end section provided with an internal slot and an open slot which are used to directly secure the measuring spoon to the protruded circular lid proximity to the top section of the internal wall of the milk powder container.

Yet still another object of the present invention is to provide a concealed spoon in milk powder container, wherein the lateral side of the spoon seat is provided with a notch.

Still a further object of the present invention is to provide a concealed spoon in milk powder container, wherein the lateral side of the clipping plate is a hook or a suspension hole, and the end of the handle of the measuring spoon has a corresponding suspension hole or a hook such that the suspension hole or the hook of the end of the measuring spoon is suspended at the suspension hook or hole of the clipping plate.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
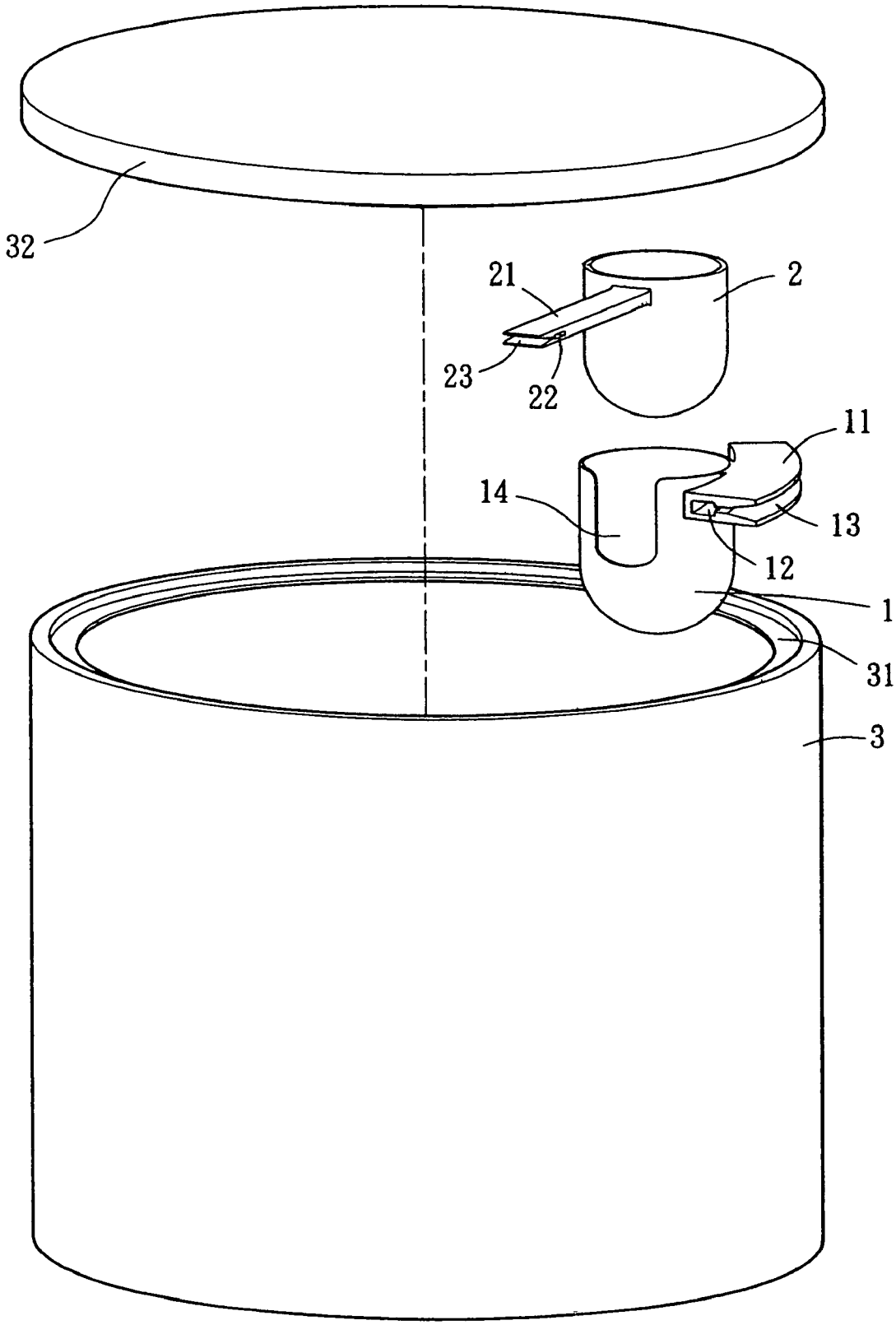
FIG. 1 is an exploded perspective view of a preferred embodiment of the present invention.

Referring to FIG 1, there is shown a first preferred embodiment of a concealed spoon within a milk powder container 3. The container 3 is provided with a cover 32 engageable with the top of the container 3. The structure includes a spoon seat I and a measuring spoon 2. The interior of the spoon seat I has a recess with a top facing opening and the lateral side of the recess has a notch 14. The recess of the spoon seat I allows the spoon 2 to be placed.

Figure 2:
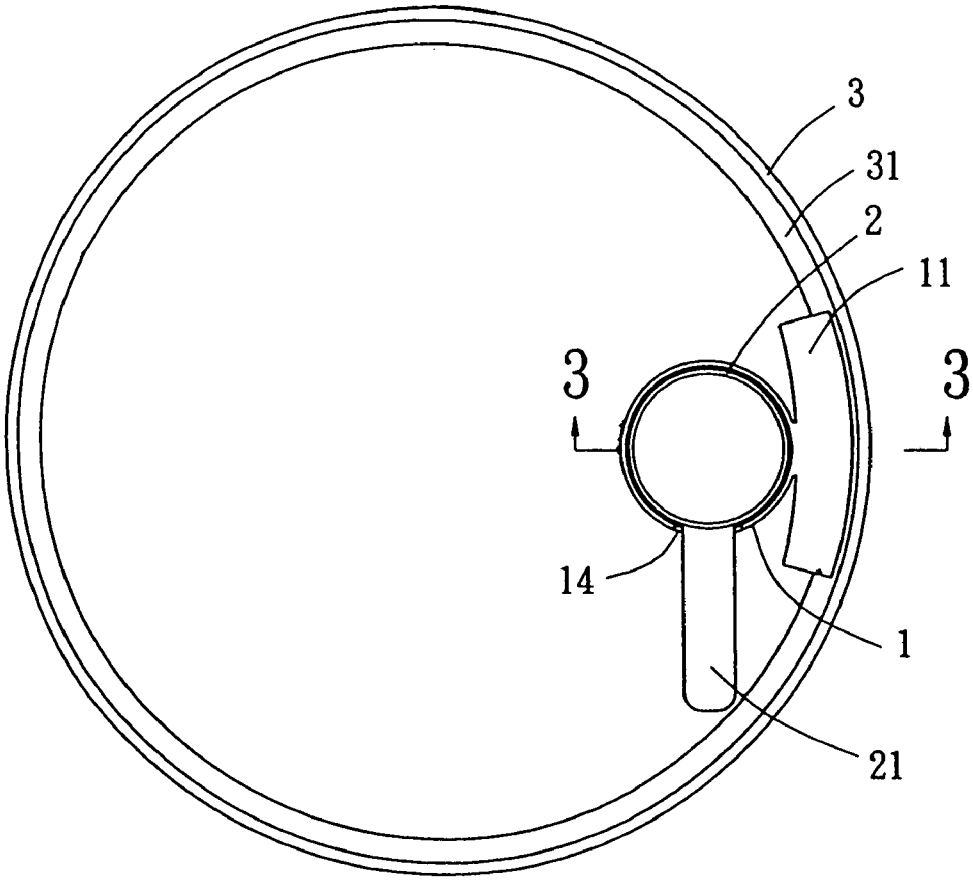
FIG. 2 is a top view of the first preferred embodiment of FIG. 1 of the present invention.
Figure 3:
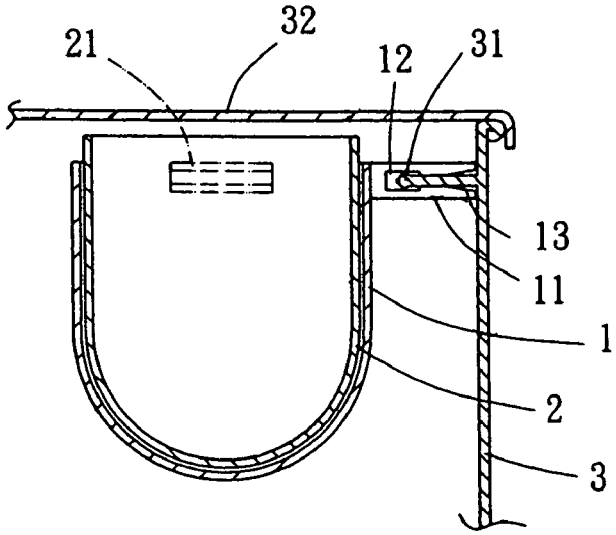
FIG. 3 is a sectional view along line 3-3 of FIG. 2 of the present invention.

The lateral side of the spoon seat I is an arch-shaped clipping plate 11 having an arch-shaped recess 12 within the clipping plate 11, and an opened recess 13 is provided between the outermost edge of the clipping plate 11 and the lateral side of the internal arch-shaped recess 12. The opened recess 13 and the arch-shaped internal recess 12 are in communication with each other such that the opened recess 13 and the internal arch-shaped recess 12 can secure the spoon seat I to the internal wall of the milk powder container proximity to the inwardly extending circular flange 31 at the top section thereof (as shown in FIGS. 2 and 3).

Figure 4:
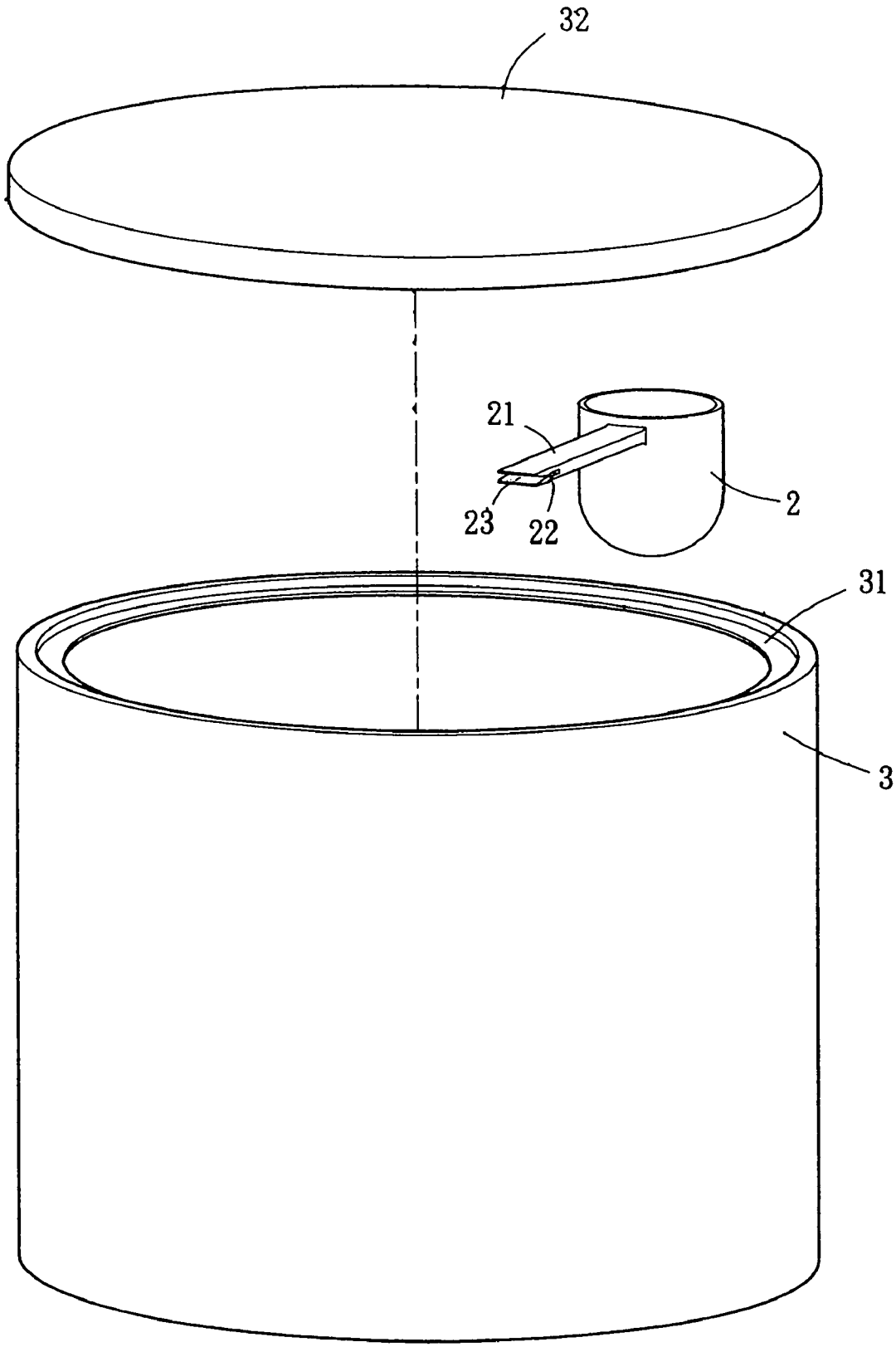
FIG. 4 is an exploded perspective view of a second preferred embodiment of the present invention.

FIG 4 is a second preferred embodiment in accordance with the present invention. The interior of the measuring spoon 2 has a recess which can use to scoop milk powder or the like.

Figure 5:
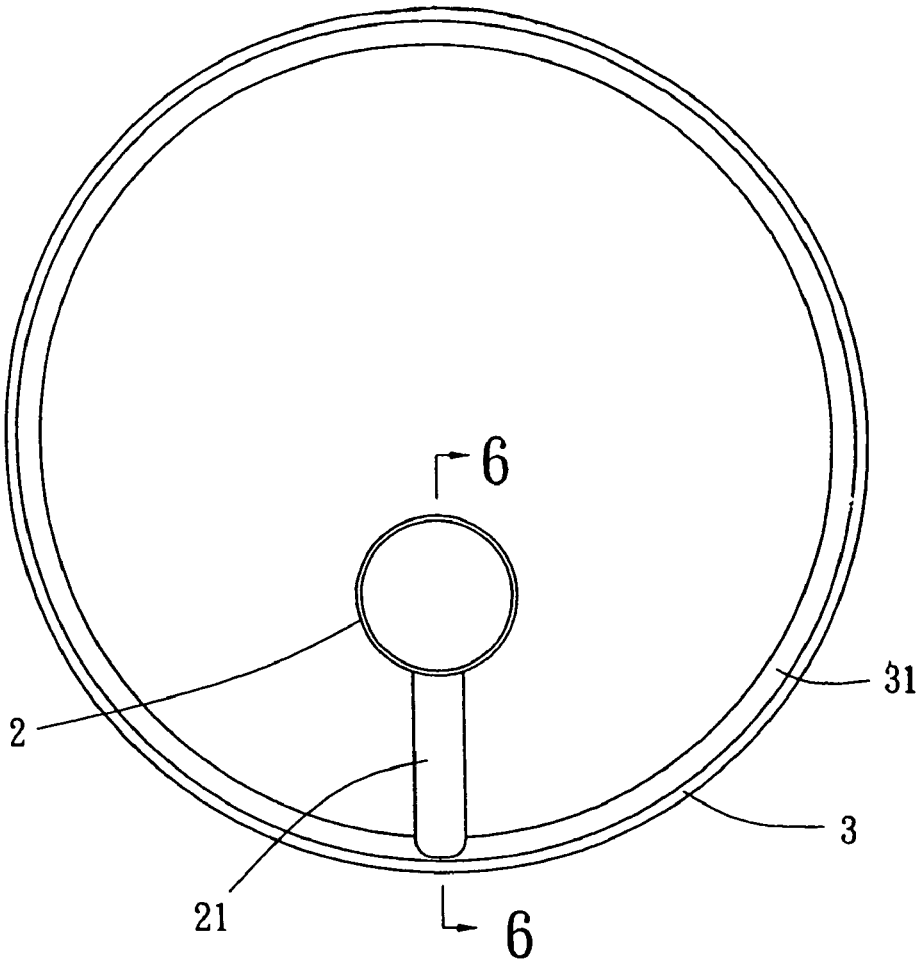
FIG. 5 is a top view of the second preferred embodiment of FIG. 4 of the present invention.
Figure 6:
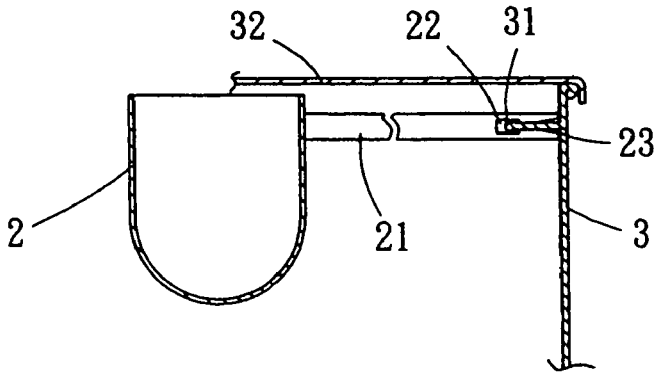
FIG. 6 is a sectional view along line 6-6 of FIG. 5 of the present invention.

The lateral side of the measuring spoon 2 has a handle 21 with an end section being provided with an internal recess 22, and an opened recess 23 is provided between the external edge of the end section of the handle to the internal recess 22, and the opened recess 23 and the internal recess 22 are in communication, such that the measuring spoon 2 is directly secured to the internal wall of the milk powder container proximity to the inwardly extending circular flange 31, as shown in FIGS. 5 and 6.

Figure 7:
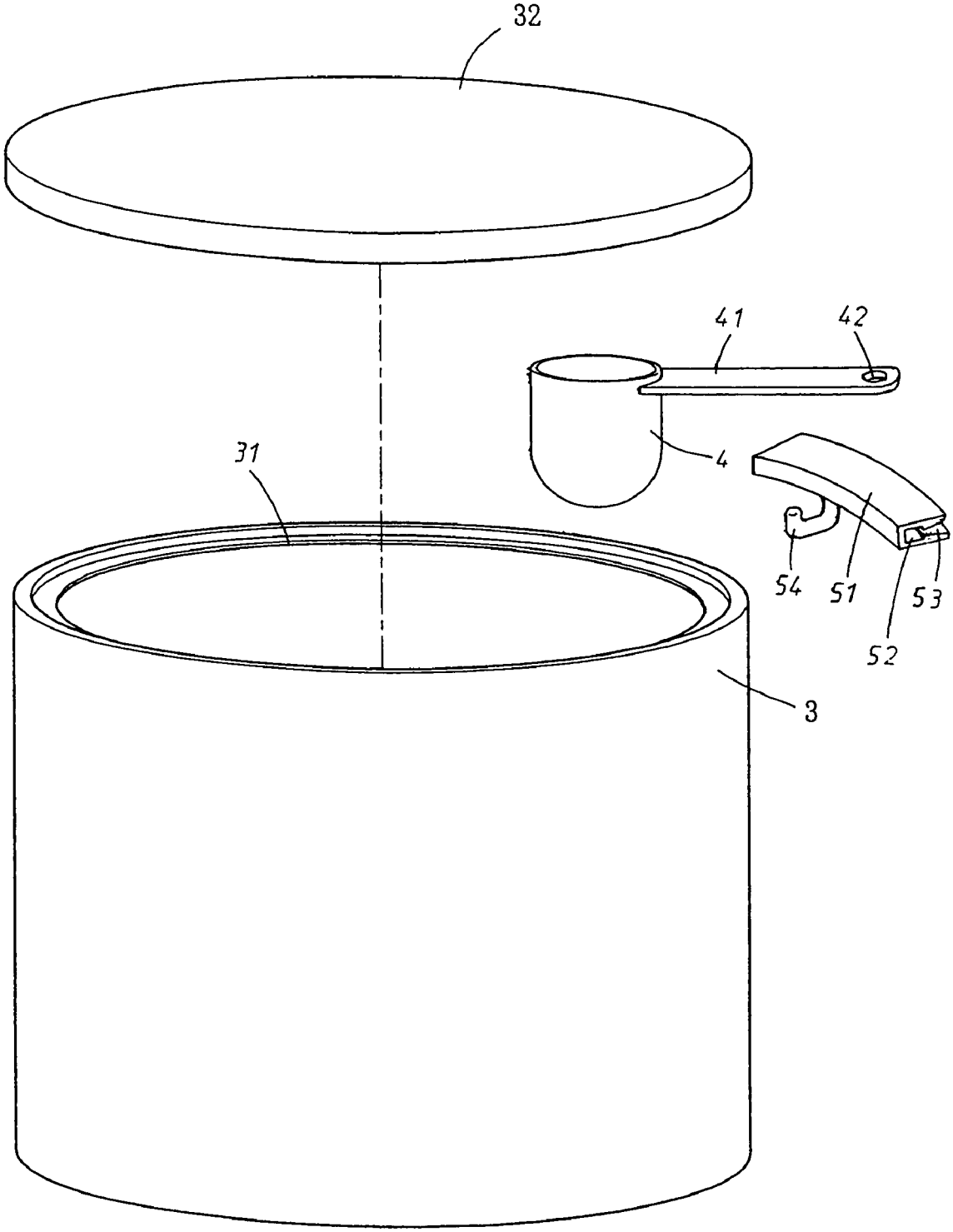
FIG. 7 is an exploded perspective view of the third preferred embodiment of the present invention.
Figure 8:
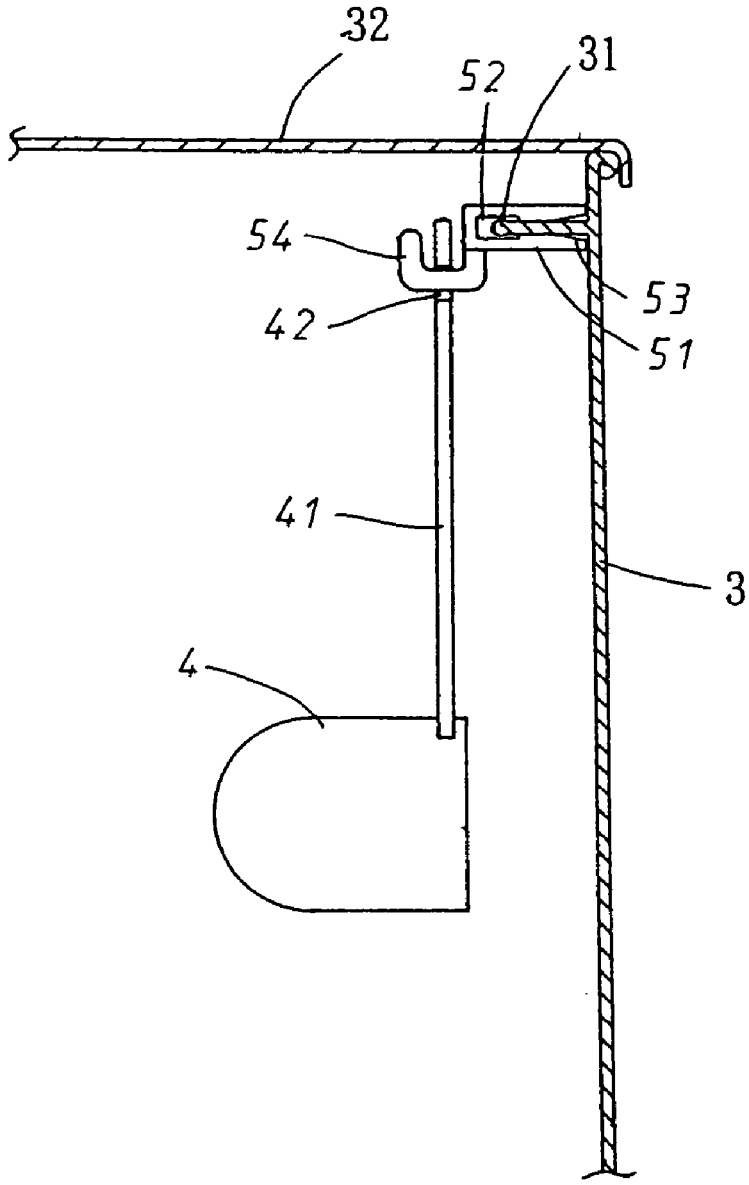
FIG. 8 is a sectional view of FIG. 7.

FIG 7 shows a third preferred embodiment in accordance with the present invention. The lateral side of the clipping plate 51 is provided with a hook 54 and the interior of the clipping plate 51 has an arch-shaped recess 52 and an opened recess 53. Similarly, the end section of the handle 41 of the measuring spoon 4 has a suspension hole 42 such that the suspension hole 42 can be directly suspended at the hook 54. The opened recess 53 and the arch-shaped recess 52 secure the clipping plate 51 onto the internal wall of the milk powder container proximity to the inwardly extending circular flange 31 and the suspension hole 42 of the measuring spoon 4 can vertically mount to the suspension hook 54, as shown in FIG 8.

Figure 9:
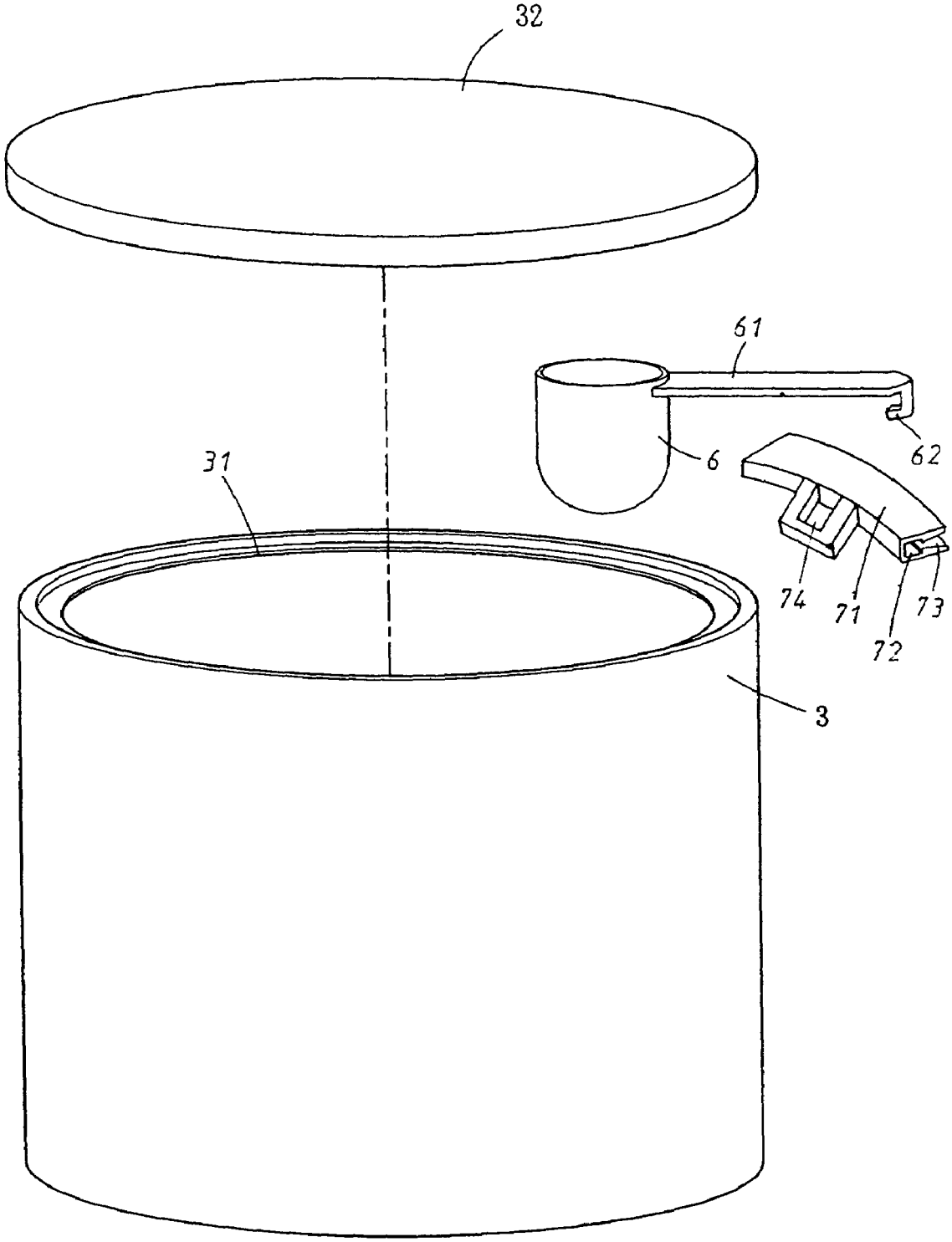
FIG. 9 is an exploded perspective view of the forth preferred embodiment of the present invention.

As shown in FIG 9, there is shown a fourth preferred embodiment of the present invention. The lateral side of the clipping plate 71 has a suspension hole 74, and the interior of the clipping plate 71 has an arch-shaped recess 72 and an opened recess 73. The end section of the handle 61 of the measuring spoon 6 can be made into a suspension hook 62. TIms, the hook 62 at the end section of the measuring spoon 6 can directly suspended to the suspension hole 74.

Figure 10:
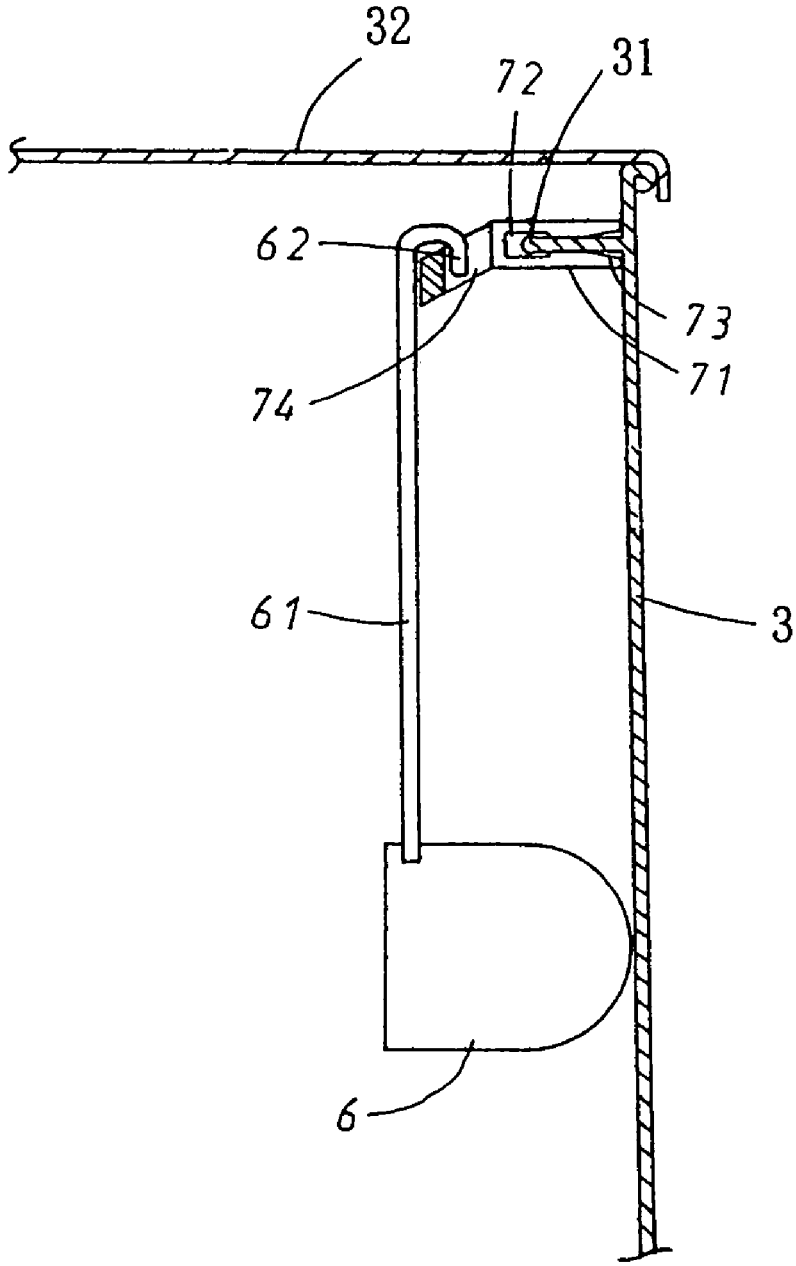
FIG. 10 is a partial sectional view of FIG. 9 of the present invention.

The opened recess 73 and the arch-shaped recess 72 can secure the clipping plate 71 to the internal wall of the milk powder container proximity to the protruded circular lid 31, and the hook 62 of the measuring spoon 6 can directly suspend at the suspension hole 74, as shown in FIG. 10.

The advantages in accordance with the present invention include (i.) the measuring spoon will not mix with the milk powder;

(ii.) the measuring spoon can be easily access when the lid is opened.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combined milk powder container and a concealed spoon, comprising:

a container having a top provided with an inwardly extending circular flange;

a cover engageable with a top of said container;

a spoon seat having a recess with a top facing opening, a lateral side of said recess having a notch, a lateral of said spoon seat being provided with an arch-shaped clipping plate, said arch-shaped clipping plate having an arch-shaped recess and an opened recess provided between an outermost edge of said clipping plate and said arch-shaped recess, said opened recess and said arch-shaped recess being in communication with each other thereby enabling said spoon seat to secure to said inwardly extending circular flange; and a measuring spoon fitted in said recess of said spoon seat, said measuring spoon having a handle extending out of said notch of said spoon seat, said handle being formed with an opened recess which is engageable with said inwardly extending circular flange of said container.

* * * * *